US005596924A

United States Patent [19]

Gerhardt

[11] Patent Number: 5,596,924

[45] Date of Patent: Jan. 28, 1997

[54] BELT PRESS FOR CONTINUOUS MANUFACTURE OF WOOD-PRODUCT MEMBERS

[75] Inventor: Klaus Gerhardt, Rheurdt, Germany

[73] Assignee: G. Siempelkamp GmbH & Co., Krefeld, Germany

[21] Appl. No.: 547,423

[22] Filed: Oct. 24, 1995

[30] Foreign Application Priority Data

Oct. 29, 1994 [DE] Germany ..... 44 38 729.6

[51] Int. Cl.[6] ..... B30B 5/06

[52] U.S. Cl. ..... 100/930 RP; 100/154; 156/583.5; 425/329

[58] Field of Search ..... 100/93 R, 93 RP, 100/120, 151, 154; 156/583.5; 425/329, 371

[56] References Cited

U.S. PATENT DOCUMENTS

| | | | |
|---|---|---|---|
| Re. 22,200 | 10/1942 | Richardson | 100/154 |
| 2,627,291 | 2/1953 | Smith et al. | 100/93 RP |
| 2,866,730 | 12/1958 | Potchen et al. | 156/583.5 |
| 2,986,083 | 5/1961 | Copeland et al. | 100/154 |
| 3,065,500 | 11/1962 | Berner | 425/329 |
| 3,215,065 | 11/1965 | Malarkey, Jr. | 100/154 |
| 3,943,025 | 3/1976 | Russell | 156/583.5 |
| 4,316,709 | 2/1982 | Petersson et al. | 100/93 RP |
| 4,330,249 | 5/1982 | Petersson et al. | 425/329 |
| 5,340,300 | 8/1994 | Saeki et al. | 425/329 |

FOREIGN PATENT DOCUMENTS

| | | | |
|---|---|---|---|
| 3044671 | 6/1982 | Germany . | |
| 4201193 | 12/1992 | Germany . | |
| 519337 | 7/1976 | U.S.S.R. | 425/329 |

*Primary Examiner*—Stephen F. Gerrity
*Attorney, Agent, or Firm*—Herbert Dubno; Andrew Wilford

[57] ABSTRACT

A continuous press for a compressible wood-product strand has a row of longitudinally spaced open frames, upper and lower heated press plates extending in a longitudinal direction through and supported by the frames, and respective upper and lower sheet-steel belts having respective lower and upper stretches extending longitudinally parallel to each other through the row of frames between the plates from the upstream to the downstream ends and defining a longitudinally extending passage having an upstream end, a downstream end, and a center between the ends. A drive advances the stretches longitudinally downstream and thereby draws in the wood-product strand longitudinally and compresses it transversely. Two sets of transversely displaceable downstream pressing elements transversely oppositely engageable between the center and the downstream end with the strand between the belts are displaceable longitudinally downstream synchronously with the strand. These pressing elements are urged transversely inward against the strand by actuators provided between the frames.

7 Claims, 4 Drawing Sheets

BELT PRESS FOR CONTINUOUS MANUFACTURE OF WOOD-PRODUCT MEMBERS

FIELD OF THE INVENTION

The present invention relates to a belt press. More particularly this invention concerns such a press used for the continuous manufacture of wood-product members, such as thick plywood or fiber sheets or beams.

BACKGROUND OF THE INVENTION

In order to make a wood-product panel, for instance a sheet of fiber board, it is standard as described in German patent 4,201,193 and U.S. Pat. No. 4,410,474 to use a continuous belt press having heated upper and lower press plates over which run lower and upper stretches of sheet-steel belts, typically via rollers, that define a longitudinally extending passage. A low-density strand formed of a mixture of wood particles and a heat-activatable binder is fed into the upstream end of this passage and the strand is compacted and heated as it moves downstream to form a hard and dense wood-product panel that is of a vertical thickness that is much smaller than that of the uncompacted strand.

This system is excellent for making large-format panels. It is, however, not suitable for making structural members which are of more compact cross section, that is of roughly equal width and thickness. Forming a large panel and cutting it into strips is an unsatisfactory solution not only because of the extra labor in cutting up the workpiece, but because the cut edges have little structural stability.

OBJECTS OF THE INVENTION

It is therefore an object of the present invention to provide an improved belt press for continuously making wood-product members of compact cross section.

Another object is the provision of such an improved belt press for continuously making wood-product members of compact cross section which overcomes the above-given disadvantages, that is which produces a finished product that is very dense and all of whose surfaces are finished and structurally stable.

SUMMARY OF THE INVENTION

A continuous press for a compressible wood-product strand has according to the invention a row of longitudinally spaced open frames, upper and lower heated press plates extending in a longitudinal direction through and supported by the frames, and respective upper and lower sheet-steel belts having respective lower and upper stretches extending longitudinally parallel to each other through the row of frames between the plates from the upstream to the downstream ends and defining a longitudinally extending passage having an upstream end, a downstream end, and a center between the ends. A drive advances the stretches longitudinally downstream and thereby draws in the wood-product strand longitudinally and compresses it transversely. Two sets of transversely displaceable downstream pressing elements transversely oppositely engageable between the center and the downstream end with the strand between the belts are displaceable longitudinally downstream synchronously with the strand. These pressing elements are urged transversely inward against the strand by actuators provided between the frames and mounted on the press plates.

Thus it is possible to exert on the workpiece, here the strand, considerable transverse force even though the press frames themselves are not typically built to with stand such transverse stress. Anchoring the pressing-element actuators on the press plates means that these plates are stressed wholly in tension so that considerable forces can be resisted. A single press can produce a workpiece that is compacted in two mutually perpendicular transverse directions so that it will be very strong. Since the pressing operations are carried out at substantially the same time, the workpiece is still hot and compactable and the result is a very strong wood-product member.

According to another feature of the invention upstream stationary shaper members are provided in the press between the center and the upstream end transversely engageable with the strand between the belts. These members serve mainly to prevent the strand from being excessively flattened and do not themselves actively laterally compact the workpiece. These members can be laterally adjustable but in all systems are longitudinally fixed, unlike the downstream pressing elements which are longitudinally movable.

The pressing elements are displaced by a plurality of hydraulic cylinders braced between the press plates and the pressing elements to each side of the strand. Each set of pressing elements is a chain having a stretch extending along a respective side of the strand and formed by a plurality of articulated pressing plates. A drive serves to synchronously advance the sets of pressing elements synchronously with the strand.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
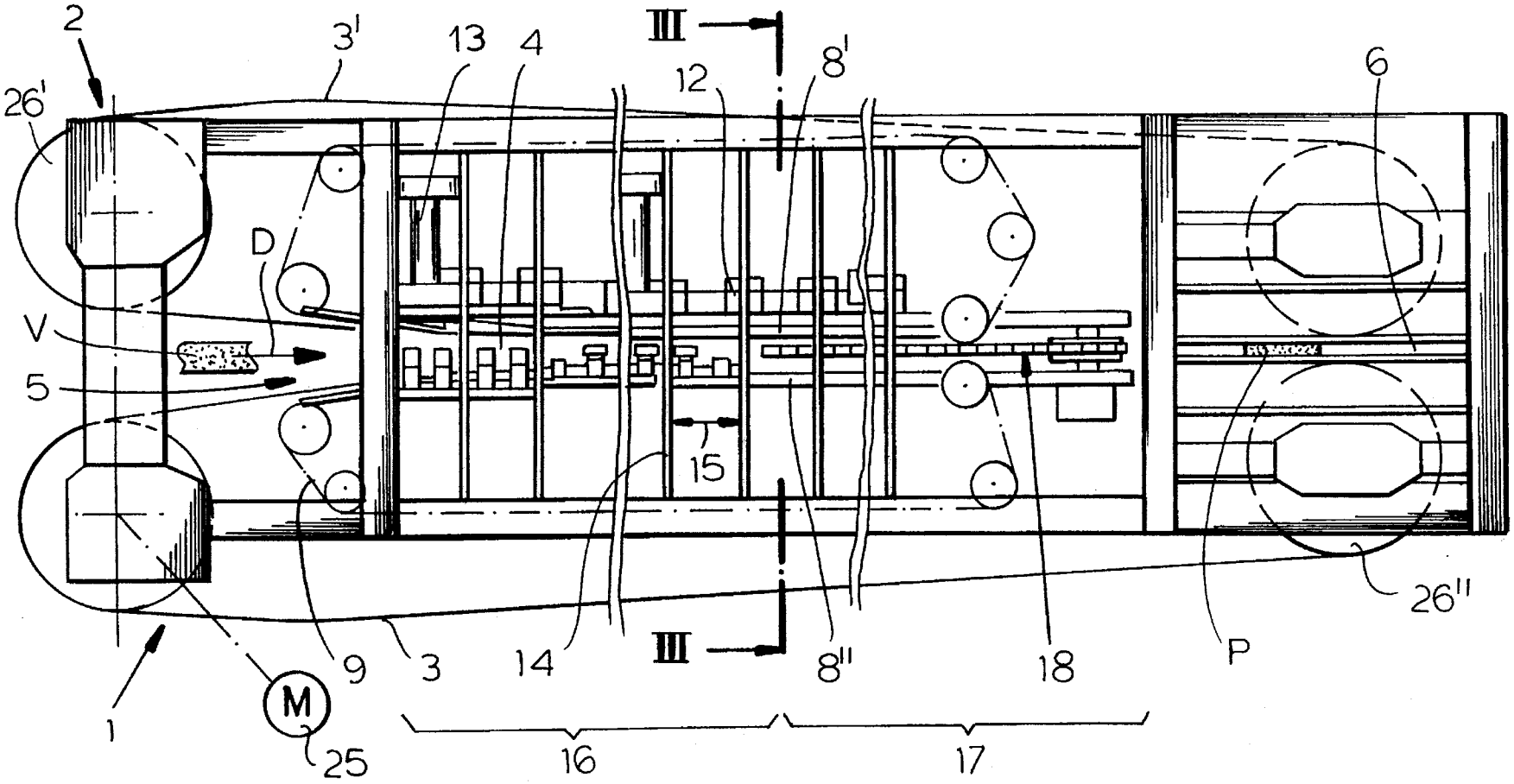
FIG. 1 is a partly schematic side view of the press according to the invention.
Figure 2:
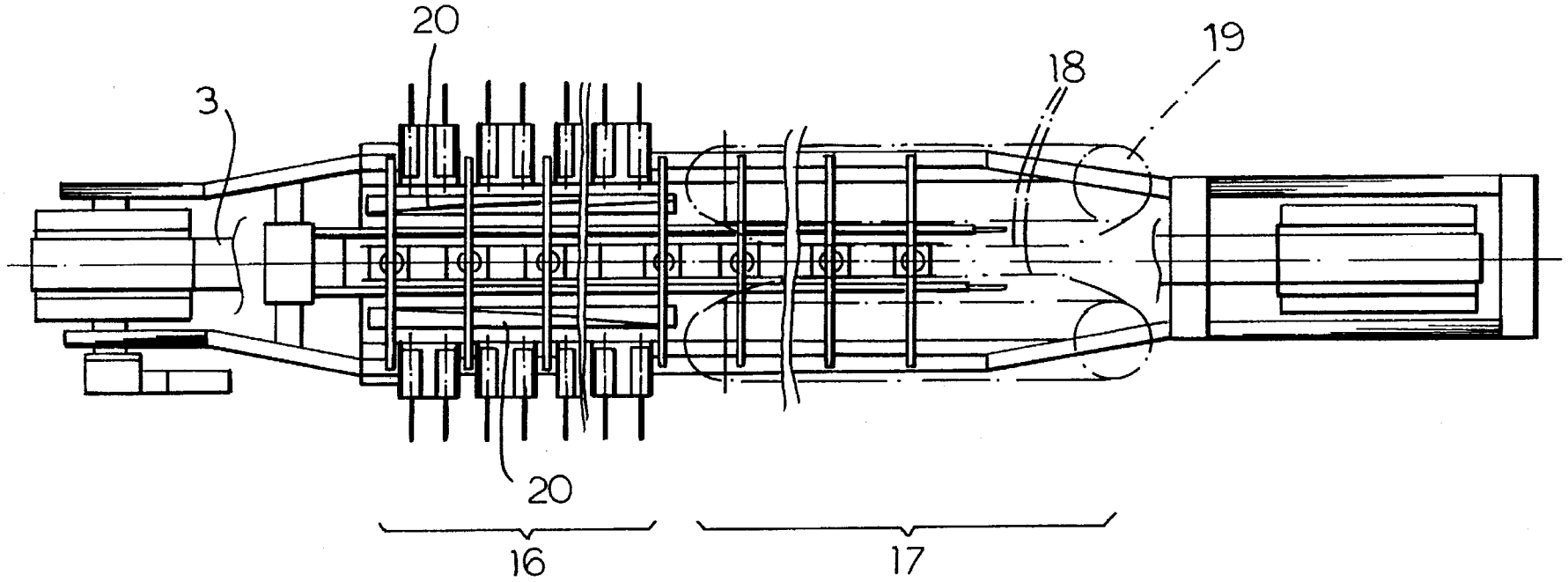
FIG. 2 is a top view of the press.
Figure 3:
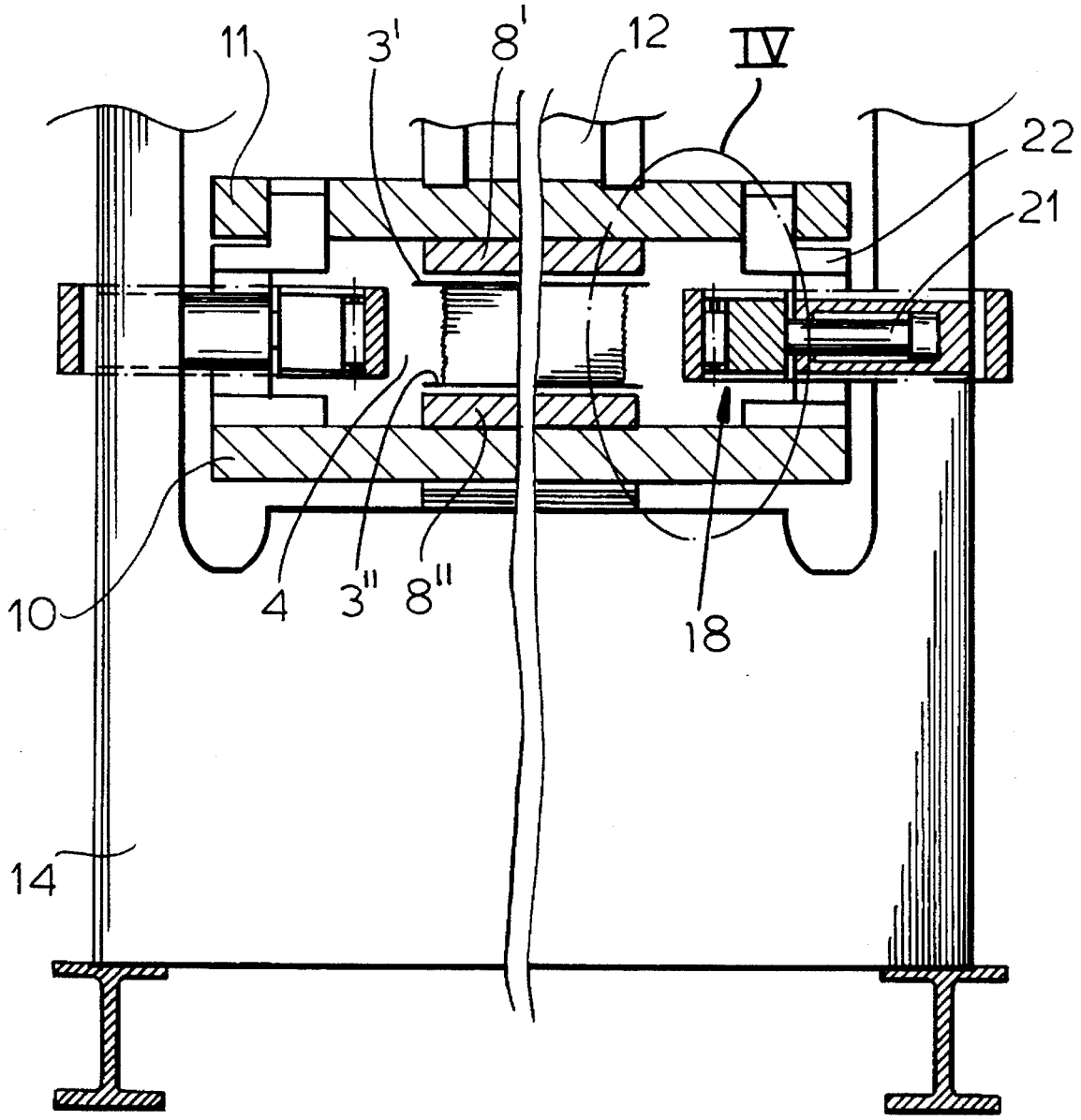
FIG. 3 is a section taken along line III—III of FIG. 1.

As seen in FIGS. 1 through 3 the press according to the invention serves has lower and upper parts 1 and 2 that serve to compact a strand V of relatively great width and height and low density into a wood-product member or beam P of smaller width and height and greater density, here slightly wider than it is high. The strand V is typically formed of fibers mixed with a heat-activatable synthetic-resin binder. The press has a plurality of planar metal frames 14 spaced apart in a workpiece travel direction D by distances 15 and supporting lower and upper press plates 10 and 11 in turn supporting lower and upper heated press platens 8' and 8". Respective belts 3' and 3" spanned over rollers 26' and 26" have lower and upper stretches that ride underneath the platens 8' and 8" to form a passage 4 having an upstream end 5 and a downstream end 6. As is known in the art, rollers 7 (FIG. 4) are fed in between the belts 3' and 3 and the respective platens 8' and 8" by recirculating units 9. The bottom plate 10 is braced directly on the frames 14 whereas an array of hydraulic actuators 12 is braced between the upper plate 11 and the frames 14 and a retraction cylinder 13 is provided at the upstream end 5 as is well known in the art.

The press passage 4 is subdivided into an upstream region 16 in which the binder in the strand V is activated and partly cured and a downstream region 17 in which the curing is completed. In the upstream region wedge-actuated side rails 20 are provided between the belts 3' and 3" to contain the sides of the strand V. In the downstream region further side shapers 18 are provided between the belts 3' and 3" spanned over vertical drums or sprockets 19.

Figure 4:
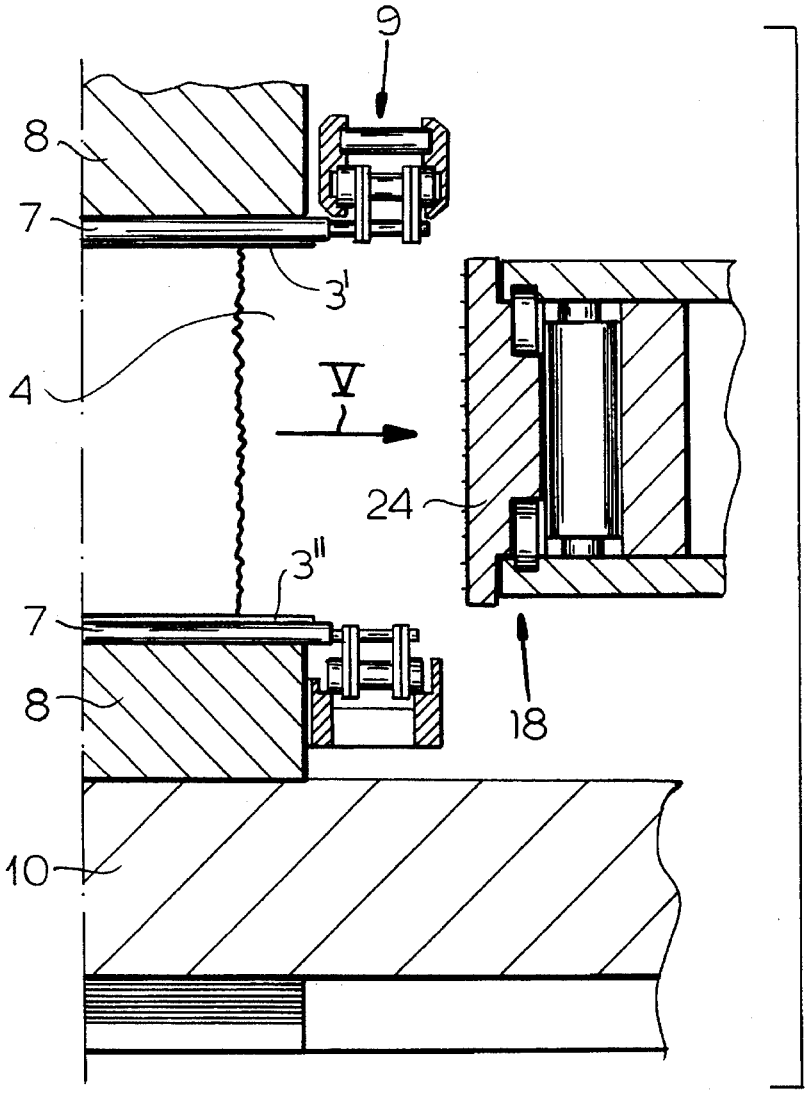
FIG. 4 is a large-scale view of the detail indicated at IV in FIG. 3.
Figure 5:
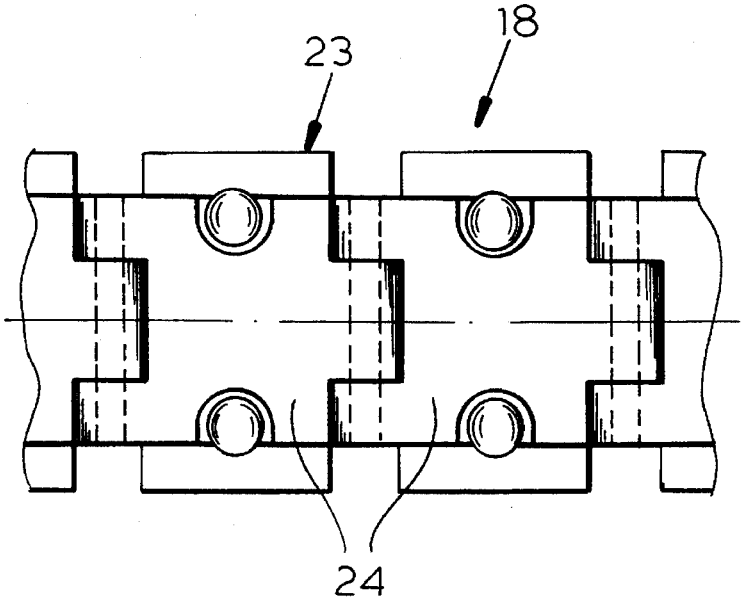
FIG. 5 is a side view taken in the direction of arrow V of FIG. 4.

As shown in more detail in FIGS. 4 and 5 these shapers 18 are each constituted as a chain 23 having a plurality of chain plates 24 and pressed by horizontally effective hydraulic cylinders 21 toward the center of the press. These cylinders are secured by mounts 22 to the lower and upper plates 10 and 11. They are not mounted on the frames 14.

Thus the strand V is initially compacted in the upstream region 16 vertically by the belts 3' and 3" and somewhat horizontally by the shapers 20. In the succeeding downstream region 17 the vertical compaction is left about the same, but the downstream chain shapers 18 are effective to press and compact the strand horizontally, turning it into a very solid member P.

I claim:

1. A continuous press for a compressible wood-product strand, the press comprising:

a row of longitudinally spaced open frames;

upper and lower heated press plates extending in a longitudinal direction through and supported by the frames;

respective upper and lower sheet-steel belts having respective lower and upper stretches extending longitudinally parallel to each other through the row of frames between the plates from the upstream to the downstream ends and defining a longitudinally extending passage having an upstream end, a downstream end, and a center between the ends;

means for advancing the stretches longitudinally downstream and thereby drawing in the wood-product strand longitudinally and compressing it transversely;

two sets of transversely displaceable downstream pressing elements transversely oppositely engageable between the center and the downstream end with the strand between the belts and displaceable longitudinally downstream synchronously with the strand; and means mounted on the press plates between the frames for urging the pressing elements transversely inward against the strand.

2. The continuous wood-product press defined in claim 1, further comprising upstream stationary shaper members in the press between the center and the upstream end transversely engageable with the strand between the belts.

3. The continuous wood-product press defined in claim 1, further comprising upstream longitudinally fixed but transversely movable shaper members in the press between the center and the upstream end laterally engageable with the strand between the belts.

4. The continuous wood-product press defined in claim 1 wherein the means between the frame includes a plurality of hydraulic cylinders braced between the press plates and the pressing elements to each side of the strand.

5. The continuous wood-product press defined in claim 4 wherein each set of pressing elements is a chain having a stretch extending along a respective side of the strand and formed by a plurality of articulated pressing plates.

6. The continuous wood-product press defined in claim 4, further comprising means for advancing the sets of pressing elements synchronously with the strand.

7. A continuous press for a compressible wood-product strand, the press comprising:

a row of longitudinally spaced open flat frames each lying in a respective transverse plane generally perpendicular to a longitudinal direction;

upper and lower heated press plates extending longitudinally through and supported by the frames;

respective upper and lower sheet-steel belts having respective lower and upper stretches extending longitudinally parallel to each other through the row of frames between the plates from the upstream to the downstream ends and defining a longitudinal passage having an upstream end, a downstream end, and a center between the ends;

means for advancing the stretches longitudinally downstream and thereby drawing in the wood-product strand longitudinally and compressing it vertically transversely;

two chains of transversely displaceable downstream pressing elements transversely oppositely engageable between the center and the downstream end with the strand between the belts and displaceable longitudinally downstream synchronously with the strand;

means for displacing the pressing elements longitudinally synchronously with the strand and belts; and means on the press plates between the frames for urging the pressing elements transversely inward against the strand.

* * * * *